US007559799B2

(12) United States Patent
Ma

(10) Patent No.: US 7,559,799 B2
(45) Date of Patent: Jul. 14, 2009

(54) ELECTRICAL CONNECTOR

(75) Inventor: Wen-Qiang Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/005,777

(22) Filed: Dec. 27, 2007

(65) Prior Publication Data

US 2008/0160830 A1 Jul. 3, 2008

(51) Int. Cl.
*H01R 13/648* (2006.01)

(52) U.S. Cl. ..... 439/607

(58) Field of Classification Search ..... 439/607, 439/608–610

See application file for complete search history.

(56) References Cited

U.S. PATENT DOCUMENTS 7,179,124 B2 * 2/2007 Zhang et al. ..... 439/607
7,422,482 B2 * 9/2008 Wang ..... 439/607
7,442,082 B2 * 10/2008 Ma ..... 439/607
7,445,506 B2 * 11/2008 Ma ..... 439/607
2005/0277333 A1 * 12/2005 Kuo ..... 439/607
2006/0052005 A1 * 3/2006 Zhang et al. ..... 439/607

* cited by examiner

*Primary Examiner*—Gary F. Paumen
(74) *Attorney, Agent, or Firm*—Wei Te Chung

(57) ABSTRACT

An electrical connector (1) comprises a metal shell (10) having a cavity (104) and defining a pair of side walls (100, 101) and a pair of end walls (102) beside the side walls, a pair of insulating housings (20) mounted on the end walls of the metal shell, a plurality of terminals (30) insert molded with the insulating housing, and a pair of shielding shells (40) covering the insulating housings. The shielding shell defines a pair of soldering tabs (4040) on the two ends thereof bearing against the side walls of the metal shell. The shielding shell are connected with the metal shell by spot welding the soldering tabs of the shielding shell to the end walls. Therefore, a firm connection is provided between the metal shell, the insulating housing, and the shielding shell.

13 Claims, 3 Drawing Sheets

ELECTRICAL CONNECTOR

BACKGROUND OF THE INVENTION

1. Field of the Invention

The present invention relates to an electrical connector, and more particularly to an electronic module connector for interconnecting an electronic module such as a camera module for use with a cellular phone or the like to an electrical member such as a printed circuit board.

2. Description of the Related Art

Conventionally, electronic modules such as a camera module for use with a cellular phone are securely maintained in electrical connection with an electronic member such as a printed circuit board. Therefore, an electrical connector for the camera module, formed in a shape that allows for secure insertion of the camera module, is pre-installed on the printed circuit board. Then, the camera module is inserted into the electrical connector to engage therewith. Consequently, the camera module is electrically connected with the printed circuit board via the electrical connector.

For example, known as an example of the aforementioned conventional technique is a camera module connector which is described in U.S. Patent Application Publication No. 2006-0216996. This connector comprises a metal shell mounted onto the printed circuit board, a pair of insulating housings assembled on the two opposite sides of the metal shell, a plurality of terminals fixed to said insulating housings, and a pair of shielding shells covered on the insulating housings, respectively. The metal shell includes a bottom wall, a pair of opposite sidewalls and a pair of opposite end walls extending vertically and upwardly from the bottom walls to define a receiving space therebetween. A plurality of locking tabs are formed on the end walls, respectively, and extend into the receiving space. Each insulating housing defines a number of locking holes corresponding with the locking tabs, and a number of retention holes beside each locking hole. And the shielding shell has a plurality of retaining tabs corresponding with the retention holes of the insulating housing. Assembly, the insulating housings are attached on the end walls of the metal shell via interference engagement between the locking tabs of the end walls and the locking holes of the insulating housing, then the shielding shells are assembled on each insulating housing via interference engagement between the retaining tabs of shielding shell and the retention holes of the insulating housing. Therefore, the metal shell, the insulating housing, and the shielding shell are assembled together.

However, said electrical connector has many members assembled by the interference engagement. Therefore, it is apt to fall apart in the course of use, and further the electrical connection may be unstable.

Thus, there is a need to provide an improved electrical connector that overcomes the above-mentioned problems.

BRIEF SUMMARY OF THE INVENTION

It is an object of the present invention to provide an electrical connector with a steady connection.

In order to achieve the objective above, an electrical connector in accordance with a preferred embodiment of the present invention comprises a metal shell with four walls defining a cavity upwardly, a pair of insulating housings assembled on the opposite sides of the metal shell, a plurality of terminals insert molding in the insulating housing, and a pair of shielding shells covering on the insulating housings. The two ends of the shielding shell define a soldering tabs which resisting the wall of the metal shell. And the shielding shell and the metal shell are connected together by spot welding the soldering tabs of the shielding shell.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

Figure 1:
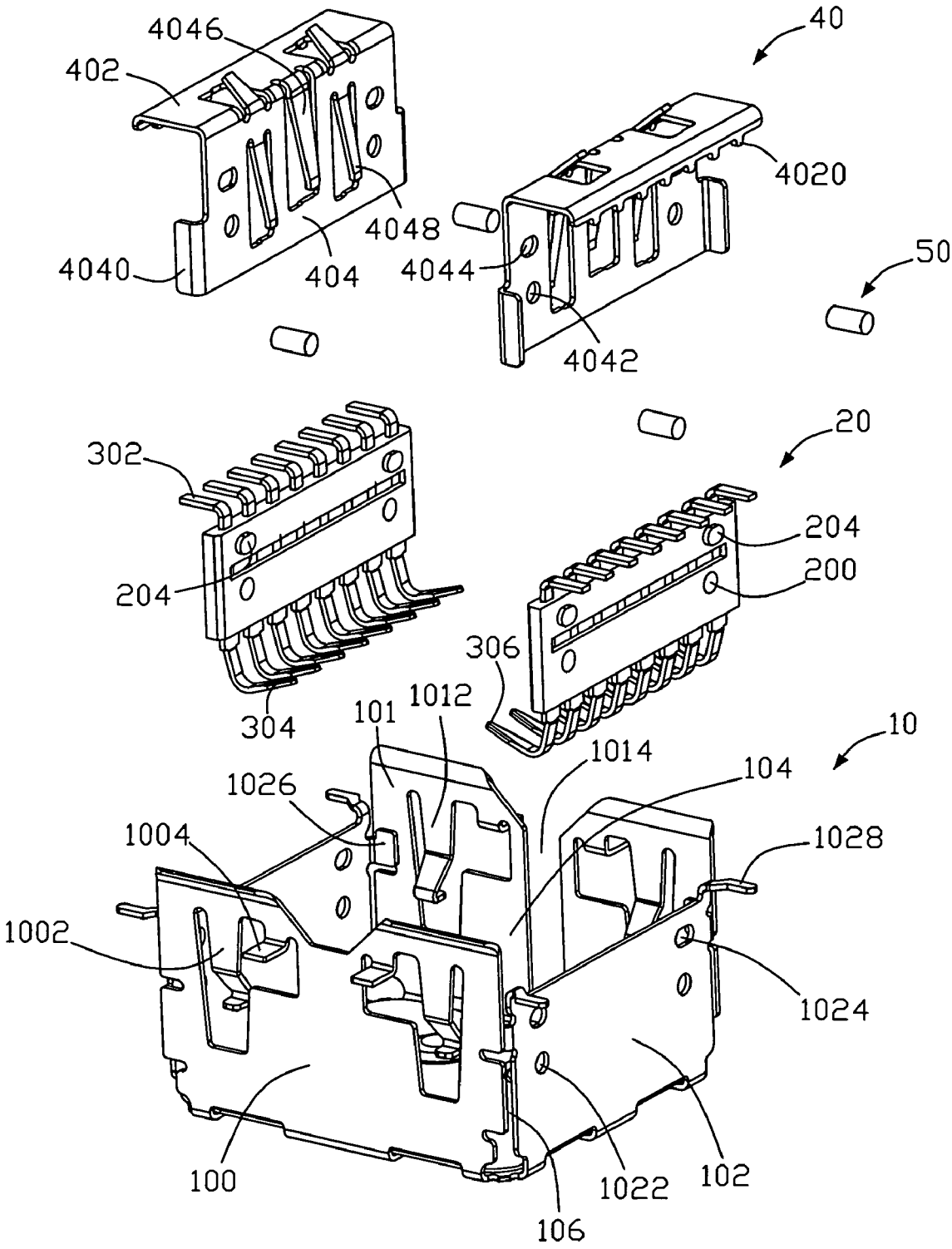
FIG. 1 is an exploded view of an electrical connector of the present invention, wherein the terminals are assembled with the insulating housing.

In the following detailed description, for purposes of explanation, numerous specific details are set forth in order to provide a thorough understanding of the present invention. It will be apparent, however, that the present invention may be practiced without these specific details. In other instances, well-known structures and devices are schematically shown in order to simplify the drawing.

An electrical connector according to the present invention is applicable to an electronic apparatus such as digital cameras, PDAs (Personal Digital Assistants), PCs (Personal Computers), mobile phones or the like. In the preferred embodiment illustrated in FIGS. 1-3, the electrical connector 1 is used in a mobile handset (not shown) for connecting a camera module (not shown) to a PCB (not shown).

FIG. 1 is an exploded perspective view of the electrical connector for receiving a camera module in the embodiment of this invention. In the figure, the reference numeral 10 denotes a metal shell made of a metal material. The reference numeral 20 denotes a pair of insulating housings made of insulating material and the reference numeral 40 denotes a pair of shielding shells made of metal material.

The metal shell 10 is made of metal material defining a cavity 104 upwardly open and includes a pair of opposite sidewalls 100, 101, a pair of opposite end walls 102 adjacent to the sidewalls 100, 101, and a flat bottom wall (not labeled) connecting the sidewalls 100, 101 and the end walls 102. The sidewalls 100, 101, the end walls 102, and the bottom wall together enclose a cavity 104 as a receiving section to receive the camera module therein.

A window 1014 is provided on a sidewall 101 for engaging with a corresponding portion of the camera module in order to prevent the camera module from being wrongly received in the cavity 104. A plurality of locking fingers 1002, 1012 extend from the sidewalls 100, 101 inward to the cavity 104 to contact with and retain the camera module. Each end wall 102 has a number of first holes 1022 and first retaining holes 1024, which are arranged in two rows and run through the metal shell 10. A retaining portion 1026 is formed on the two ends of the end walls 102 in order to resist the end of the insulating housing 20. A plurality of soldering portions 1004, 1028 extend outwardly from the sidewalls 100, 101 and the end walls 102 along the horizontal direction in order to mount on the printed circuit board.

Referring again to FIG. 1, each insulating housing 20 is made of insulating material and configured as a flat plate. The insulating housings 20 are assembled on the two end walls 102 of the metal shell 10 respectively by a number of second holes 200 corresponding with the first holes 1022, and a plurality of retaining sections 204 on a side thereof corresponding with the first retaining holes 1024 and also on an opposite thereof.

A plurality of terminals 30 are configured in a "Z"-shape, each comprising a vertical section (not labeled) insert molded with the insulating housing 20, a soldering section 302 extending upwardly and outwardly from one end of the vertical section in order to mount on the printed circuit board, and a contact section 304 extending downwardly and slantly from the other end of the vertical section with a contact portion 306 to contact with electrical pads formed on the bottom surface of the camera module.

Each shielding shell 40 mounted on the end walls 102 of the metal shell 10 comprises a vertical body portion 404 and a horizontal portion 402 extending laterally from an upper edge of the vertical body portion 404. The vertical body portion 404 has a flexible finger 4046 and a pair of resilient fingers 4048 located on two sides of the flexible finger 4046, all protruding inwardly for pressing the camera module. The vertical body portion 404 further comprises a pair of soldering tabs 4040 to connect with the metal shell 10 by spot welding. The horizontal portion 402 has a plurality of soldering pads 4020 on the end thereof so as to connect to the printed circuit board. Furthermore, the vertical body portion 404 has a pair of third holes 4042 corresponding with the first holes 1022 of the metal shell 10 and the second holes 200 of the insulating housing 20, and a pair of a second retaining holes 4044 corresponding with the first retaining holes 1024 of the metal shell 10 and the retaining section 204 of the insulating housing 20.

The electrical connector 1 further comprises a plurality of retaining members, such as a retaining stick 50, which penetrate the first holes 1022 of the metal shell 10, the second holes 200 of the insulating housing 20, and the third holes 4042 of the shielding shell 40 in turn so as to provide a steady connection therebetween via interference engagement.

Figure 2:
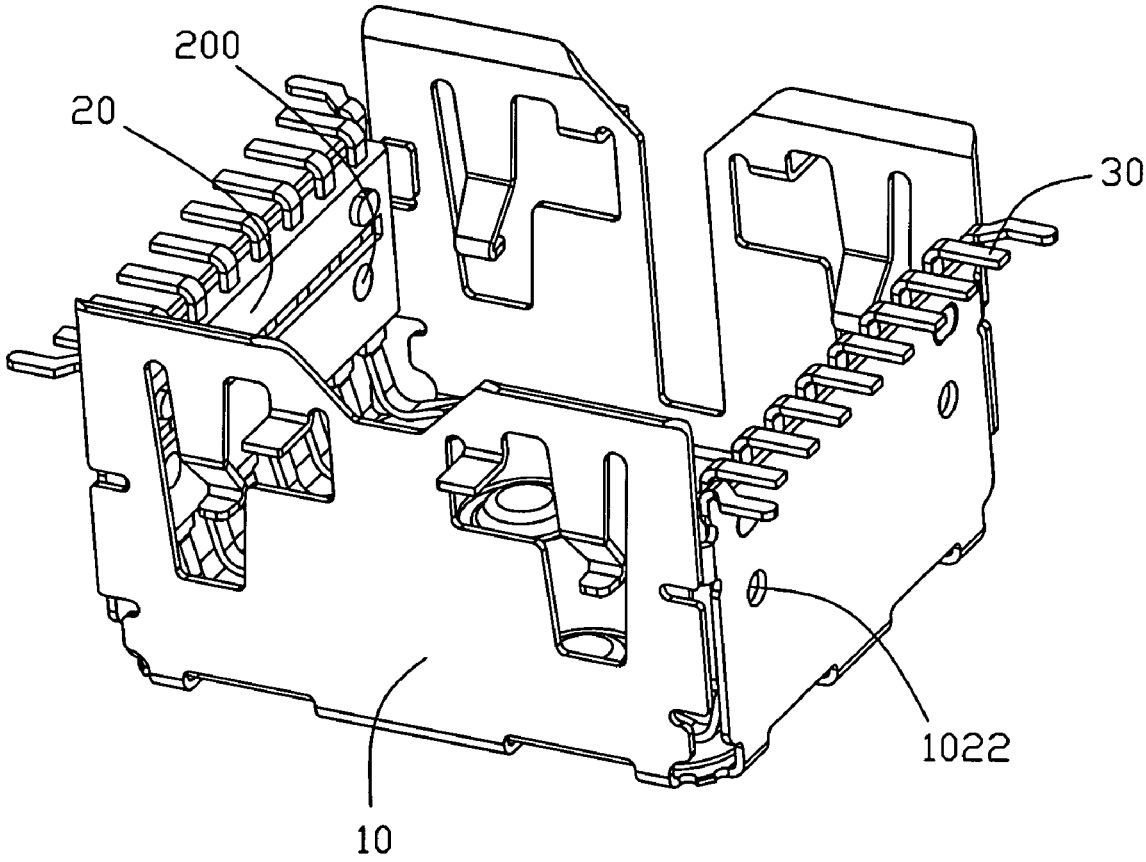
FIG. 2 is a partly assembled perspective view of the electrical connector of the present invention.
Figure 3:
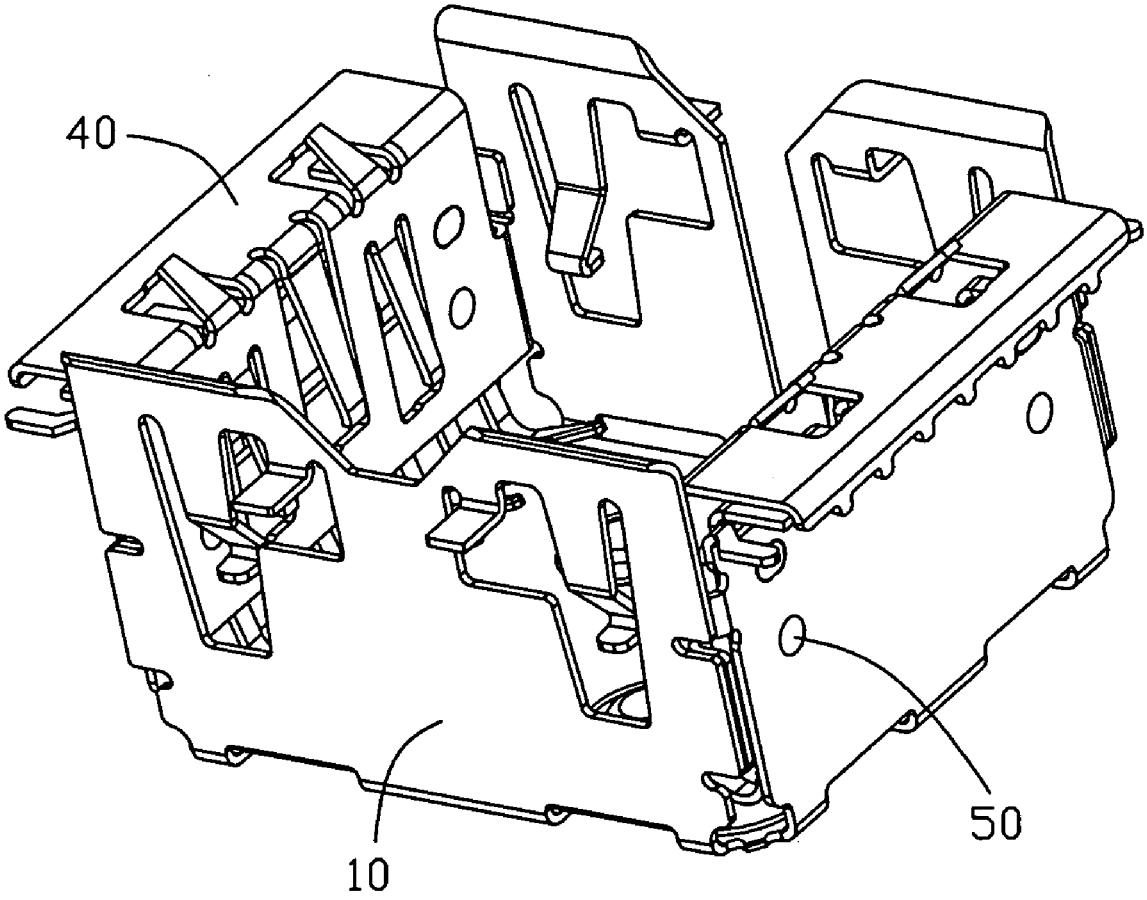
FIG. 3 is a perspective view of the electrical connector of the present invention.

Referring to FIGS. 2 and 3, in assembling the electrical connector 1, firstly, the terminals 30 are assembled with the insulating housing 20 by insert molding. Secondly, the insulating housings 20 with the terminals 30 and the shielding shells 40 are mounted on the end walls 102 of the metal shell 10, with the retaining sections 204 of the insulating housing being inserted into the first retaining holes 1024 of the metal shell 10 and the second retaining holes 4044 of the shielding shell 40 and with the retaining portions 1026 of the metal shell 10 bearing against the two ends of the insulating housings 20, and the soldering tabs 4040 of the shielding shells 40 bearing against with the sidewalls 100 of the metal shell 10 and being connected with the metal shell 10 by spot welding. The contact sections 304 of the terminals 30 extend into the cavity 104 of the metal shell 10 so as to contact with the electrical pads formed on the bottom face of the camera module and the soldering sections 302 extend outwardly of the insulating housings 20 so as to connect to the printed circuit board. Then, the retaining sticks 50 penetrate the first holes 1022 of the metal shell 10, the second holes 200 of the insulating housing 20, and the third holes 4042 of the shielding shell 40 in turn by interference fit.

When the camera module is inserted into the cavity 104 from above, the contact pads on the bottom face thereof are brought into contact with the contact sections 304 of the terminals 30, and the locking fingers 1002,1012 of the metal shell 10, the flexible finger 4046 and the resilient fingers 4048 of the shielding shells 40 contact with the outer periphery of the camera module so as to hold the camera module in the cavity 104 steadily. Therefore, the camera module is electrically connected to the printed circuit board via the terminals 30. Finally, the electrical connector 1 with the camera module is connected to the printed circuit board by the soldering portions 1004, 1028 of the metal shell 10, the soldering sections 302 of the terminals 30, and the soldering pads 4020 of the shielding shells 40.

In the above description of the preferred embodiment, each shielding shell 40 has a pair of soldering tabs 4040, and said soldering tabs 4040 bear against the inner faces of the sidewalls 100 of the metal shell 10 and are connected with the metal shell 10 by spot welding so as to provide a steady connection therebetween.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for electrically connecting an electrical member to a printed circuit board, comprising:

a metal shell defining a cavity for receiving the electrical member therein;

a pair of insulating housings assembled with the metal shell;

a plurality of terminals insert molded with the insulating housing; and a pair of shielding shells covering the insulating housings, wherein each shielding shell has a soldering tab, and the metal shell is connected with the shielding shell by the soldering tab of the shielding shell.

2. The electrical connector according to claim 1, wherein the metal shell comprises a pair of sidewalls and a pair of end walls adjacent to the sidewalls, and the soldering tabs of the shielding shell bear against the sidewalls.

3. The electrical connector according to claim 2, wherein the shielding shell comprises a pair of soldering tabs extending from both ends thereof.

4. The electrical connector according to claim 1, wherein the shielding shell comprises a vertical body portion and a horizontal portion extending laterally from an upper edge of the vertical body portion, and the soldering tabs are disposed on the vertical body portion.

5. The electrical connector according to claim 1, further comprising a retaining member, and the metal shell, the insulating housing, and the shielding shell respectively define a first, second, and third holes receiving the retaining member.

6. The electrical connector according to claim 5, wherein the insulating housing defines a pair of retaining sections above the second holes.

7. The electrical connector according to claim 6, wherein the metal shell and the shielding shell respectively comprises a pair of first and second retaining holes receiving the retaining section.

8. The electrical connector according to claim 7, wherein each terminal comprises a vertical section, a soldering section extending upwardly and outwardly from one end of the vertical section, and a contact section extending downwardly and slantly from the other end of the vertical section.

9. The electrical connector according to claim 8, wherein the metal shell comprises a plurality of horizontal soldering portions.

10. The electrical connector according to claim 9, wherein the soldering portions of the metal shell and the soldering sections of the terminals are located in a common horizontal plane.

11. The electrical connector according to claim 1, wherein the soldering tab is spot welded to the shielding shell.

12. An electrical connector comprising:

a metallic shield defining four side walls in a circumferential manner to commonly define a receiving cavity;

a pair of terminal modules disposed on inner faces of opposite two of said four side walls, each of said terminal modules including a plurality of terminals each defining a lower contacting section extending into the receiving cavity and an upper soldering section for mounting to a printed circuit board;

a pair of shielding shells each covering an inner surface of the corresponding terminal module, and cooperating with the corresponding side wall to sandwich the corresponding terminal module therebetween.

13. The electrical connector as claimed in claim 12, wherein each of said shielding shell defines a horizontal section on a top portion thereof to cover the soldering section which extends outwardly horizontally.

* * * * *